US007358915B2

(12) United States Patent
Legay et al.

(10) Patent No.: US 7,358,915 B2
(45) Date of Patent: Apr. 15, 2008

(54) PHASE SHIFTER MODULE WHOSE LINEAR POLARIZATION AND RESONANT LENGTH ARE VARIED BY MEANS OF MEMS SWITCHES

(75) Inventors: Hervé Legay, Plaisance du Touch (FR); Gérard Caille, Tournefeuille (FR); Alexandre Laisne, Vains (FR); David Cadoret, Rennes (FR); Raphael Gillard, Rennes (FR)

(73) Assignee: Thales, Neuilly-sur-Seine (FR)

( * ) Notice: Subject to any disclaimer, the term of this patent is extended or adjusted under 35 U.S.C. 154(b) by 264 days.

(21) Appl. No.: 11/086,304

(22) Filed: Mar. 23, 2005

(65) Prior Publication Data

US 2005/0212705 A1 Sep. 29, 2005

(30) Foreign Application Priority Data

Mar. 23, 2004 (FR) ..... 04 50575

(51) Int. Cl.
*H01Q 13/10* (2006.01)
*H01Q 3/24* (2006.01)

(52) U.S. Cl. ..... 343/768; 343/770; 343/876

(58) Field of Classification Search ..... 343/700 MS, 343/767, 768, 770, 876
See application file for complete search history.

(56) References Cited

U.S. PATENT DOCUMENTS 6,184,839 B1 2/2001 Butscher et al.
6,307,519 B1 * 10/2001 Livingston et al. ..... 343/767
6,388,631 B1 5/2002 Livingston
6,417,807 B1 * 7/2002 Hsu et al. ..... 343/700 MS
6,864,848 B2 * 3/2005 Sievenpiper ..... 343/767
2003/0122721 A1 7/2003 Sievenpiper

OTHER PUBLICATIONS

P. M. Backhouse et al, "Antenna-Coupled Microwave Phase Shifters Using GAAS Varactors", Electronics Letters, IEE Stevenage, GB< vol. 27, No. 6, Mar. 14, 1991, pp. 491-492, XP000225079.

H. S. Newman—Institute of Electrical and Electronics Engineers: "RF MEMS Switches and applications", 2002 IEEE International Reliability Physics Symposium Proceedings. 40th Annual. Dallas, TX, Apr. 7-11, 2002, IEEE International A Reliability Physics Symposium, NY, NY, IEEE, Apr. 7, 2002, pp. 111-115, XP010589210.

Kim Jung-Mu et al, "A 5-17 ghz wideband reflection-type phase shifter using digitally operated capacitive mems switches", Conference Proceedings Articles, vol. 1, Jun. 9, 2003, pp. 907-910, XP010646855.

* cited by examiner

*Primary Examiner*—Shih-Chao Chen
(74) *Attorney, Agent, or Firm*—Sughrue Mion, PLLC

(57) ABSTRACT

A phase shifter module (CD), dedicated to a reflectarray antenna, is defined by a characteristic resonant length and, in at least one chosen place, has an MEMS type device (DC, DC') able to be placed in at least two different states respectively permitting and prohibiting the establishing of a short-circuit intended to vary said resonant length, in order to vary the phase shifting of a wave to be reflected presenting at least one linear polarization.

23 Claims, 9 Drawing Sheets

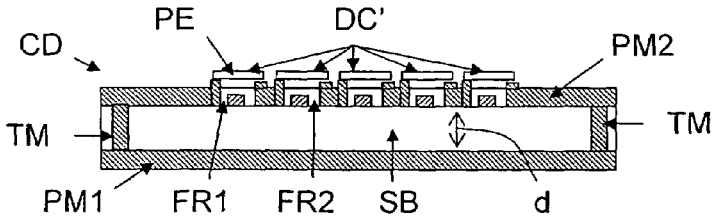
FIG.8
FIG.9
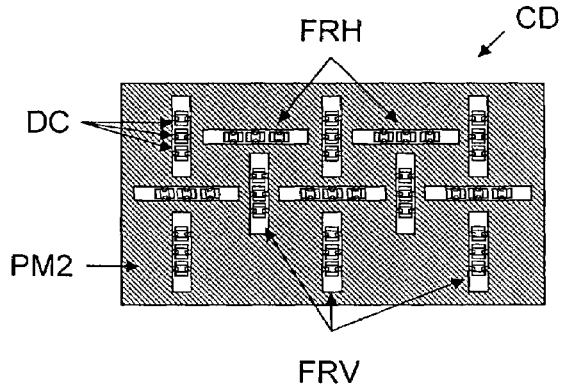
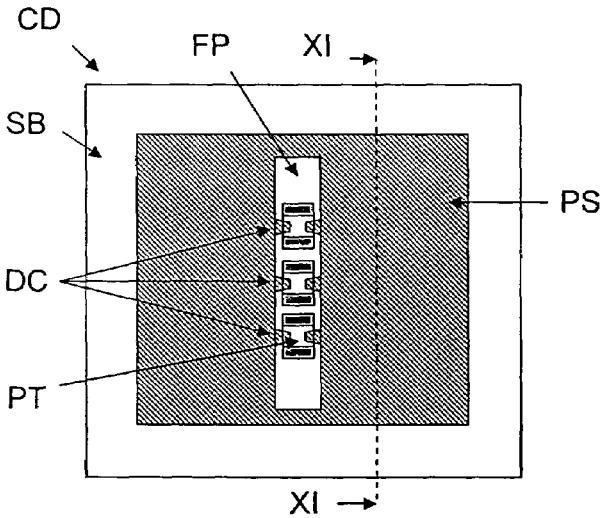
FIG.10

FIG.11
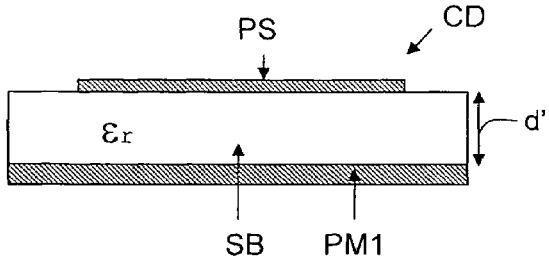
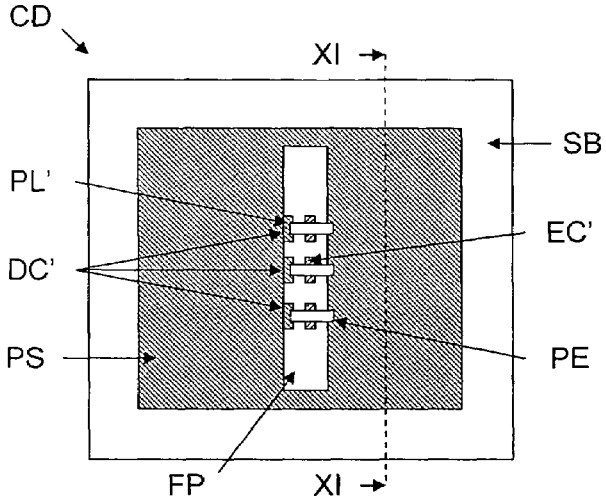
FIG.12
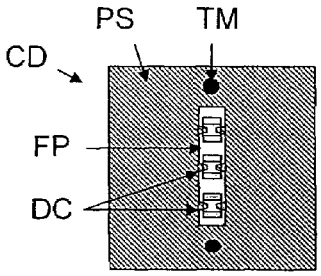
FIG.13
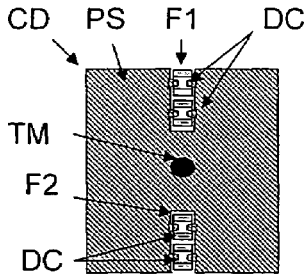
FIG.14
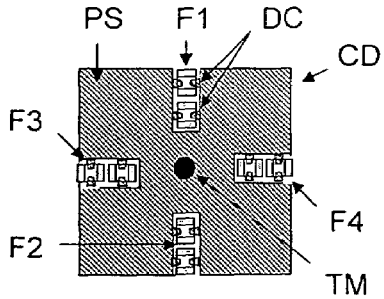
FIG.15

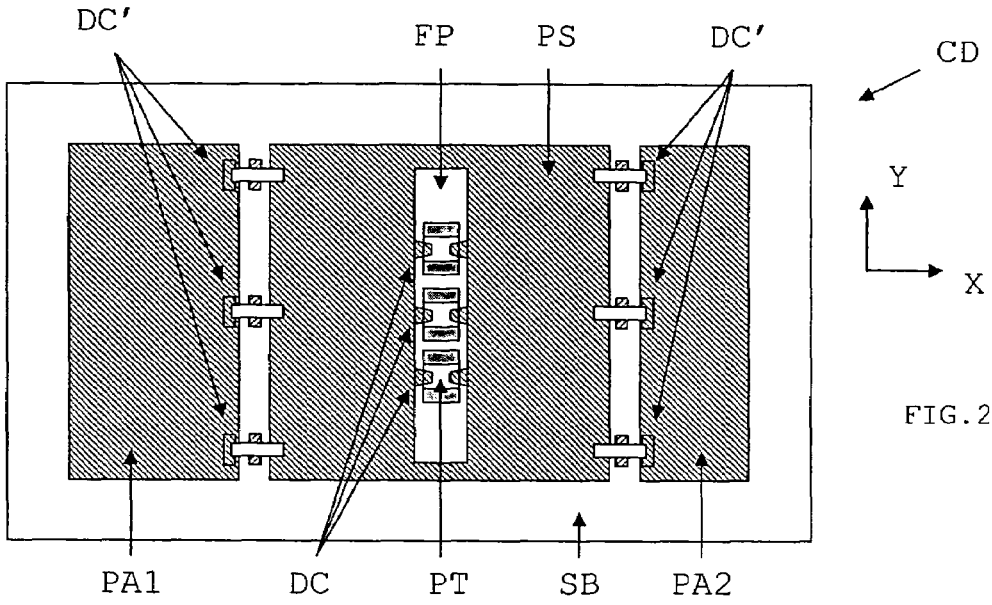
FIG.23
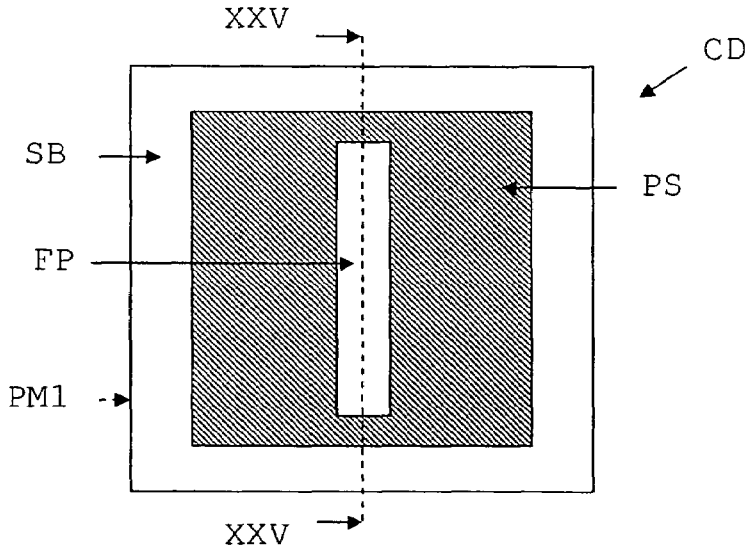
FIG.24
FIG.25
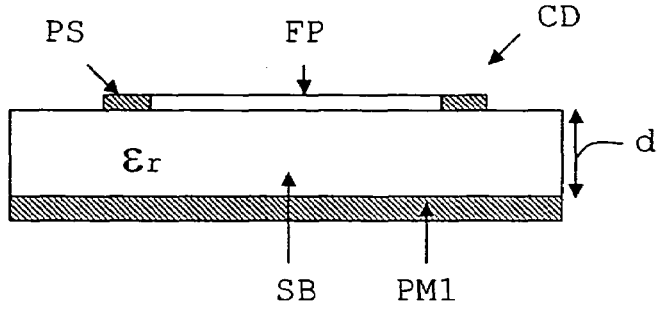

degres = degrees

PM = GP

CD = PSM

TM = MH

FR = RS

LA = AL

PT = BR

PL = ST

DC = SD

PE = BE

PLC = CST

SB = SB

EC = CE

FRH = HRS

FRV = VRS

FP = IS

PS = UP

PA = AP

Z = Z

PI = LW

PHASE SHIFTER MODULE WHOSE LINEAR POLARIZATION AND RESONANT LENGTH ARE VARIED BY MEANS OF MEMS SWITCHES

BACKGROUND OF THE INVENTION

1. Field of the Invention

This application claims priority under 35 U.S.C. § 119 from French Patent Application No. 04 50 575, filed on Mar. 23, 2004, in the French Intellectual Property Office, the disclosure of which is incorporated herein by reference in its entirety.

The invention concerns the field of reflectarray antennas, and more particularly the phase shifter modules that equip such antennas.

2. Description of the Related Art

Reflectarray antennas are one of the two main array antenna families, the other family being phased array antennas. These array antennas are particularly advantageous as they can be reconfigured, for example to allow switching from one coverage area (or "spot") to another.

A reflectarray antenna is made up of radiating elements designed to intercept, with minimum losses, waves consisting of signals to be transmitted, emitted by a primary source, in order to reflect them in a chosen direction, known as the pointing direction. To allow the reconfigurability of the antenna diagram, each radiating element is equipped with a phase control device with which it forms a passive or active phase shifter module.

"Phase shifter module" is understood to mean both radiating cavity and slot structures and radiating patch resonant planar structures.

The invention more particularly concerns linear polarization active phase shifter modules. These usually consist of a phase shifter module with a switch made up of diodes (usually the PIN type), MESFETs, varactors, or mechanical control devices (such as, for example, a motor designed to move a dielectric rod).

Switch-operated phase shifter modules consume a large amount of energy and are subject to significant losses and heating. Mechanical control phase shifter modules are complicated to implement, in particular in the case of large arrays, and consume a lot of energy. In both cases, the disadvantages entailed by the phase control techniques used limit the applications of phase shifter modules, particularly in the aerospace field, and more specifically in observation platforms, such as satellites, for example.

The object of the invention is therefore to improve the situation in the case of linear polarization active phase shifter module reflectarray antennas.

To this end, it proposes a phase shifter module with a characteristic resonant length that, in at least one selected place, has an MEMS (Micro ElectroMechnical System) device able to be placed in at least two different states respectively permitting and prohibiting the establishing of a short-circuit intended to vary the characteristic resonant length, in order to vary the phase shifting of the waves to be reflected that present at least one linear polarization.

Each MEMS device may, for example, consist of a flexible conducting bridge whose states are controlled by two control electrodes that are placed roughly on top of each other, one of which is comprised of the bridge. Alternatively, each MEMS device may consist of a suspended flexible conducting beam (or cantilever) whose states are controlled by a control electrode placed below its suspended section.

In one family of embodiments, the module may have a resonant planar structure consisting of at least one rectangular upper patch placed roughly parallel to a lower ground plane, at a selected distance, the lower ground plane defining at least one conducting "wafer", that may be rectangular, for example, completely surrounded by a non-conducting zone, placed below the upper patch and of smaller dimensions. In this case, the module has at least one metallic bushing connecting the upper patch to the wafer and the MEMS device is placed in the non-conducting zone, in order to establish, in one of its states, a link between the wafer and the rest of the ground plane to control the resonant length of the upper patch.

The lower ground plane may possibly define at least two wafers (that may be rectangular, for example) completely surrounded by a non-conducting zone, placed below the upper patch and of smaller dimensions. In this case, the module has at least two metallic bushings respectively connecting the upper patch to one of the wafers, and at least two MEMS devices each placed in one of the non-conducting zones, in order to establish links between at least one of the wafers and the rest of the ground plane, allowing the defining of at least three upper patch resonant lengths that differ according to their states.

As a variant of this family of embodiments, the module may consist of an upper ground plane with at least one radiating slot, equipped with an MEMS device controlling its characteristic resonant length, a lower ground plane and metallic bushings connecting the lower ground plane to peripheral sections of the upper ground plane in order to define a resonant cavity. For example, the upper ground plane may have at least two radiating slots, each equipped with a single MEMS device controlling their characteristic resonant length. Each MEMS device may thus preferably be placed roughly in the middle of a radiating slot. Furthermore, the slots are preferably roughly parallel to each other and may have slightly different lengths. They may also be curved, however, so that together they form an annular slot short-circuited at two roughly opposite points.

Alternatively, the upper ground plane may have one radiating slot, equipped with at least two MEMS devices allowing the defining of at least three resonant lengths that differ according to their states.

Moreover, the upper ground plane may possibly have at least one rectangular radiating slot with large sides parallel to a first direction, and at least one other rectangular radiating slot with large sides parallel to a second direction perpendicular to the first, in order to allow a double linear polarization.

In another family of embodiments, the module may consist of a resonant planar structure comprising an upper patch placed roughly parallel to a lower ground plane, at a selected distance. In this case, the patch has at least one slot equipped with at least one MEMS device controlling its characteristic resonant length.

The module may thus have a single slot (of a half-wave length) equipped with at least two MEMS devices, allowing the defining of at least three resonant lengths that differ according to their states. As an alternative, the upper patch may be roughly square and the module may have at least a first and second rectangular slot (of a quarter-wave length) placed roughly opposite each other, coming out onto two non-radiating opposite sides of the square, each being equipped with at least two MEMS devices, allowing the defining of at least three resonant lengths that differ according to their states. In this last case, the module may also have at least a third and fourth rectangular slot (of a quarter-wave length) placed roughly opposite each other, coming out onto two non-radiating opposite sides of the square, each being equipped with at least two MEMS devices, allowing the defining of at least three resonant lengths that differ according to their states. Several upper patches may also be used, each with at least one quarter-wave half-slot, with pairs of half-slots opposite each other then forming half-wave slots.

In the presence of a bridge MEMS device and rectangular slots, the bridge is preferably placed roughly parallel to the large sides of the slot. However, in the presence of a beam MEMS device and rectangular slots, said beam is preferably placed roughly perpendicularly to the large sides of the slot.

Furthermore, the lower ground plane may define a lower patch placed below the upper patch and of smaller dimensions. In this case, the module has metallic bushings that connect the ground plane to peripheral sections of the upper patch, in order to define a resonant cavity. This patch and cavity structure defines a further family of phase shifter modules.

The invention also proposes a reflectarray antenna equipped with at least two phase shifter modules of the type presented above.

The invention is particularly suited, although not exclusively, to Ku-band geostationary telecommunication antennas (12 to 18 GHz) with reconfigurable coverage (changing of orbital position, adapting of traffic), and to band C (4 to 8 GHz) or band X (8 to 12 GHz) radar antennas, and SARs in particular.

BRIEF DESCRIPTION OF THE DRAWINGS

Other features and advantages of the invention will appear on examination of the detailed description below, and of the drawings appended, in which:

FIG. 8 is a cross-sectional view along the axis VIII-VIII of the phase shifter module in FIG. 7, FIG. 9 schematically illustrates, in a top view, a fifth embodiment example of a phase shifter module according to the invention, FIG. 10 schematically illustrates, in a top view, a sixth embodiment example of a phase shifter module according to the invention, FIG. 11 is a cross-sectional view along the axis XI-XI of the phase shifter modules in FIGS. 10 and 12, FIG. 12 schematically illustrates, in a top view, a seventh embodiment example of a phase shifter module according to the invention, FIG. 13 schematically illustrates, in a top view, an eighth embodiment example of a phase shifter module according to the invention, FIG. 14 schematically illustrates, in a top view, a ninth embodiment example of a phase shifter module according to the invention, FIG. 15 schematically illustrates, in a top view, a tenth embodiment example of a phase shifter module according to the invention, FIG. 16 schematically illustrates, in a top view, an eleventh embodiment example of a phase shifter module according to the invention, FIG. 25 is a cross-sectional view along the axis XXV-XXV of the phase shifter module in FIG. 24.

The drawings appended may not only complete the invention, but also contribute to its definition, where applicable.

DETAILED DESCRIPTION OF THE EXEMPLARY EMBODIMENTS

The invention concerns a linear polarization active phase shifter module for an active reflectarray antenna.

The reflectarray antenna may, for example, be dedicated to telecommunications, for example Ku-band (12 to 18 GHz) geostationary telecommunications with reconfigurable coverage (changing of orbital position or adapting of traffic), or band C (4 to 8 GHz) or band X (8 to 12 GHz) radars, SARs (synthetic aperture radars) in particular, or high-throughput ISL-RF type links, particularly within a small constellation of satellites flying in formation.

Generally speaking, a phase shifter module, according to the invention, consists of an MEMS (Micro ElectroMechanical System) device in one or several selected places. Each MEMS device may be placed, through electrical controls, in at least two different states respectively permitting and prohibiting the establishing of a short-circuit intended to vary one of the module's characteristic resonant lengths, in order to vary the phase shifting of the waves to be reflected (originating from the antenna's source) presenting at least one linear polarization.

Such a phase shifter module may belong to one of three major families depending on its radiating structure. A first family consists of radiating cavity and slot structures, a second family consists of patch resonant planar structures and a third family consists of cavity resonant planar structures.

FIGS. 1 to 9 are first of all referred to in describing embodiment examples of phase shifter modules belonging to the first family.

Figure 2:
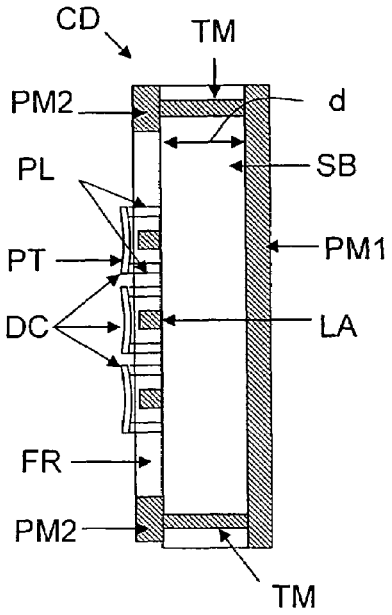
FIG. 2 is a cross-sectional view along the axis II-II of the phase shifter module in FIG. 1, FIG. 3 schematically illustrates, in a top view, a second embodiment example of a phase shifter module according to the invention.
Figure 1:
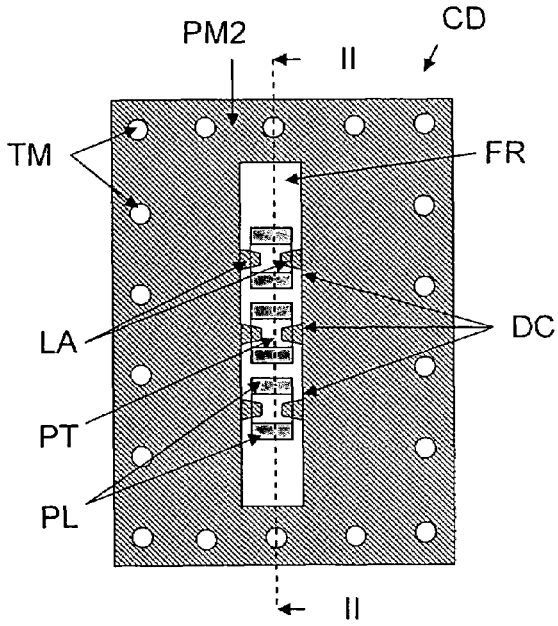
FIG. 1 schematically illustrates, in a top view, a first embodiment example of a phase shifter module according to the invention.

FIGS. 1 and 2 illustrate a first example of a phase shifter module CD consisting of a substrate SB with a "back" (or "lower") face, joined to a "lower" ground plane PM1, and a "front" (or "upper") face, joined to an "upper" ground plane PM2.

The substrate SB is made, for example, from Duroid or TMM, and has a thickness equal, for example, to $\lambda/4$, where $\lambda$ is the vacuum wavelength of the waves to be reflected, originating from the antenna's source.

The lower ground plane PM1 and the upper ground plane PM2 are electrically connected together by means of metallic holes (or bushings) TM formed in the substrate SB. These planes are made, for example, from alumina, silicon or glass substrates which, owing to their small thicknesses (typically 500 gm), must be laid onto a Duroid or TMM substrate SB to achieve a thickness equal to $\lambda/4$. The metallic holes TM are preferably arranged around the outside of the lower ground plane PM1 and the upper ground plane PM2, in order to define a resonant cavity.

Two techniques may be envisaged for creating this assembly. A first technique consists of laying a Duroid (or Metclad) substrate, around 3 mm thick, for example, on top of an alumina substrate, around 0.254 mm thick, for example, then placing a lower ground plane PM1 on the lower face of the Duroid substrate and an upper ground plane PM2 on the upper face of the alumina substrate, said upper ground plane PM2 being locally interrupted by the slots. A second technique consists of only using a Duroid (or Metclad) substrate, around 2 or 3 mm thick, for example, then forming on its upper face portions of an intermediate ground plane in which are formed voltage control lines, then laying onto this upper face portions of alumina substrates, around 0.245 mm thick, for example, with on an upper face an upper ground plane PM2, each with one or several slots, then placing a lower ground plane PM1 on the lower face of the Duroid substrate, and finally connecting the lower, intermediate and upper ground planes through two levels of metallic holes (or bushings).

The upper ground plane PM2 also has a single radiating slot FR, preferably rectangular in shape, defined by two large (longitudinal) sides of length b, and two small (transverse) sides of width a.

This radiating slot FR is created, for example, by etching the upper ground plane PM2.

Furthermore, the radiating slot FR has a parallel LC resonance. The parameters of such a resonator (resonance frequency and bandwidth) depend mainly on the lengths b and the width a of the radiating slot FR, and on the permittivity $\in_r$ of the substrate SB.

Several modes may be propagated in the cavity delimited by the metallic holes TM. Each of these modes has a specific propagation constant $\beta$ and a specific characteristic impedance $Z_0$. The cavity mode cut-off frequency depends mainly on the length $m_y$ and the width $m_y$ of the lower ground plane PM1 and the upper ground plane PM2, and on the permittivity or of the substrate SB. Remember also that a vertical resonance may occur in this type of cavity if its thickness d is equal to $n\lambda_g/^2$, where n is an integer and $\lambda_g$ is the wavelength of the guided mode(s) propagated in the cavity.

For example, a square mesh array may be chosen, in which $m_x=m_y=0.7\lambda=8$ mm. In this case, and with a wavelength $\lambda$ corresponding to a working frequency of 26.4 GHz, the cavity has a cut-off frequency equal to 18.75 GHz and only functions in its fundamental mode, which corresponds to a guided wavelength $\lambda_g$ equal to around 16.14 mm, in the case of an air cavity.

With a cavity of a thickness equal to $\lambda/4$ (which here is around $\lambda_g/5.7$), phase shifts of up to 360° may be obtained with widths a of slot FR of between around 0.25 mm and around 1 mm. For example, with a width equal to 0.5 mm, the phase shift's inflexion point is obtained at the resonance of the slot FR, which corresponds to a length b equal to around 5.5 mm, taking into account the other values previously stated.

In this embodiment, the radiating slot FR is preferably centered in the middle of the upper ground plane PM2. However, this may not be the case, in particular in the presence of an additional parasite slot. In this last case, the slots are preferably located symmetrically in relation to the centre of the module.

Moreover, in this embodiment example, the radiating slot FR is equipped with three MEMS devices DC each constituting a two-state switch. Of course, the radiating slot may have a different number of MEMS devices DC if this number is at least equal to one.

Each MEMS device DC here consists of a flexible conducting bridge PT whose ends are joined to retaining studs PL that are themselves joined to the upper face of the substrate SB. These studs PL are made, for example, from Gold or Aluminum and are slightly thicker than the upper ground plane PM2. The flexible bridge PT is made in the form of a blade made conductive, for example, through Gold or Aluminum plating, and installed in the slot FR roughly parallel to its longitudinal edges.

Furthermore, each MEMS device DC consists of two control electrodes placed roughly on top of each other, one of these comprising of the flexible bridge PT and the other being, for example, placed at a higher level above the flexible bridge PT (not shown), these two electrodes being connected to a power-supply circuit (not shown).

In addition, on the upper face of the substrate SB, inside the radiating slot FR and roughly in a central section of its longitudinal edges, two small access lines LA may be placed roughly opposite each other, perpendicularly to the flexible bridge PT, and electrically connected to the upper ground plane PM2.

In the presence of a control current chosen at control electrode level, the suspended section of the bridge PT is attracted to said access lines LA. The suspended section then bends until it comes into contact with the two access lines LA, which locally generates a short-circuit in the radiating slot FR and reduces its characteristic resonant length (b), which is its electrical length. This constitutes one of the two states of the MEMS device DC.

In the absence of a control current, the bridge PT is apart from the access lines LA, so that the length of the radiating slot FR is not altered. This constitutes the other state of the MEMS device DC.

By separately controlling the various MEMS devices DC, it is therefore possible, in this embodiment example, to define three short-circuits in three different positions, corresponding to at least four different resonant lengths, for the slot FR. Of course, the positions of the various MEMS devices DC are chosen to allow the regular quantification of the phase rule. This positional constraint favors the arranging of the MEMS devices on the edges of the slot. These different resonant lengths correspond to different phase shifts of the wave reflected by the phase shifter module CD.

Figure 4:
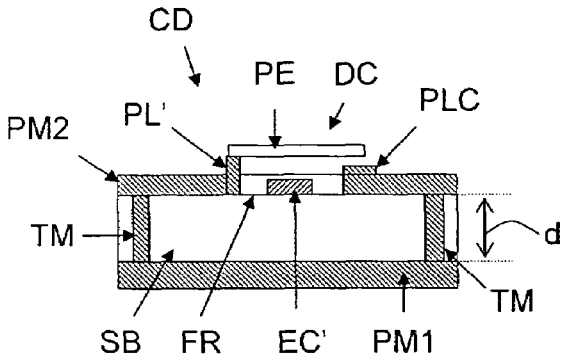
FIG. 4 is a cross-sectional view along the axis IV-IV of the phase shifter module in FIG. 3, FIG. 5 schematically illustrates, in a top view, a third embodiment example of a phase shifter module according to the invention.
Figure 3:
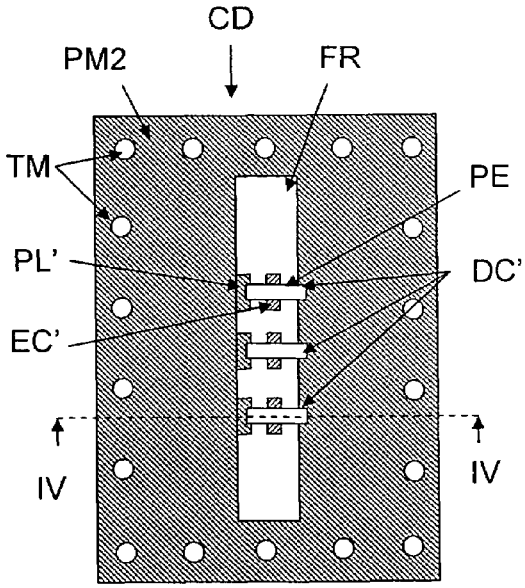

FIGS. 3 and 4 illustrate a second example of a phase shifter module CD of the first family. This is a variant of the phase shifter module CD described above with reference to FIGS. 1 and 2. More specifically, what differentiates the first embodiment example from the second is the embodiment of the MEMS devices.

Here, each MEMS device DC consists of a conducting flexible beam (or cantilever) PE with an end joined to a conducting retaining stud PL', formed in the radiating slot FR along one of the longitudinal edges and electrically connected to the upper ground plane PM2.

This stud PL' is made, for example, from Gold or Aluminum and is slightly thicker than the upper ground plane PM2, so that the beam PE is suspended above the radiating slot FR and the level of the upper ground plane PM2. The flexible beam PE is made in the form of a blade made conductive, for example, through Gold or Aluminum plating, installed roughly perpendicularly to its longitudinal edges. The free end of the beam PE crosses the slot FR across its width and slightly juts out onto the upper ground plane PM2 at a place where an electrically conductive contact stud PLC is preferably placed.

Moreover, each MEMS device DC' consists of a control electrode EC' placed below the central suspended section of the beam PE and connected to a power-supply circuit (not shown), another electrode being comprised of the conducting flexible beam PE. The control electrode EC' is formed on the upper face of the substrate SB, inside the radiating slot FR.

In the presence of a control current chosen at control electrode EC' level, the suspended section of the beam PE is attracted to said electrode. It therefore bends until its free end comes into contact with the contact stud PLC, which locally generates a short-circuit in the radiating slot FR and reduces its characteristic resonant length (b), which is its electrical length. This constitutes one of the two states of the MEMS device DC'.

In the absence of a control current, the free end of the beam PE is apart from the contact stud PLC, so that the length of the radiating slot FR is not altered. This constitutes the other state of the MEMS device DC'.

By separately controlling the various MEMS devices DC', it is therefore also possible, in this embodiment example, to define three short-circuits in three different positions, corresponding to at least four different resonant lengths, for the slot FR. Of course, the positions of the various MEMS devices DC' are chosen to allow the regular quantification of the phase rule. These different resonant lengths correspond to different phase shifts of the wave reflected by the phase shifter module CD.

In this embodiment example, the radiating slot FR is equipped with three MEMS devices DC'. However, the radiating slot FR may have a different number of MEMS devices DC' if this number is at least equal to one.

Figure 5:
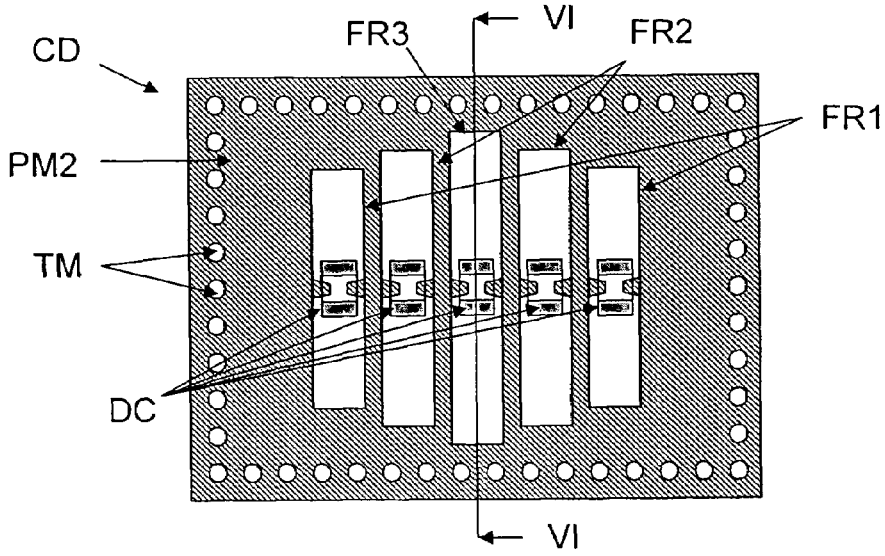
Figure 6:
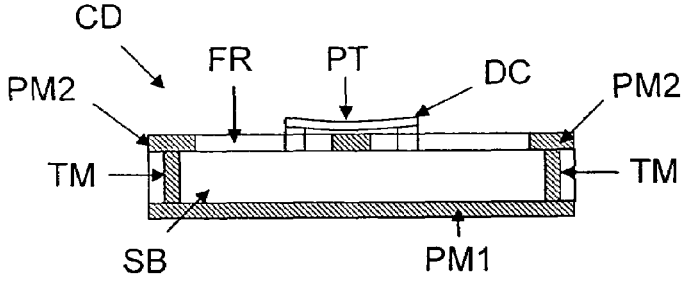
FIG. 6 is a cross-sectional view along the axis VI-VI of the phase shifter module in FIG. 5, FIG. 7 schematically illustrates, in a top view, a fourth embodiment example of a phase shifter module according to the invention.

FIGS. 5 and 6 illustrate a third example of a phase shifter module CD of the first family. In this example, the phase shifter module CD has the same structure as the first example described above with reference to FIGS. 1 and 2, but it has several radiating slots (N=5) instead of just one, and each slot has a single MEMS device DC with a bridge PT. Of course, the number N of radiating slots illustrated is not limitative. It may take any value greater than or equal to two. Furthermore, at least one of the slots may not be equipped with an MEMS device.

Some radiating slots may have different lengths. More specifically, in the example illustrated, the upper ground plane PM2 has two end radiating slots FR1, with a first characteristic resonant length L1, two intermediate radiating slots FR2, with a second characteristic resonant length L2 greater than L1, and a central radiating slot FR3, with a third characteristic resonant length L3 greater than L2. In one variant, the five slots may have five different lengths.

Here, the five radiating slots FR1 to FR3 are roughly centered in relation to the middle of the upper ground plane PM2, and their MEMS device DC with a bridge PT is also installed in a centered position. However, other alternatives are possible. Indeed, in the example described above, the undesirable slots are short-circuited, but the resonant length of some of them may also be modified in order to excite several resonances and effectively control the phase shifting between slots, with coupling.

The distance separating two neighboring slots may be fixed or variable. It varies according to need. It is typically between around 100 μm and 500 μm.

In this case, only one or several radiating slots are used, their respective MEMS devices DC being placed in their second state (not arrowed). The slots that are not required are short-circuited, by placing their MEMS devices DC in their first state (arrowed). The phase variation of the reflected wave is therefore obtained here by selecting one of the combinations of short-circuited and non-short-circuited slots. Indeed, a specific and discrete phase shift corresponds to each combination, mainly according to the ratio between the smallest characteristic resonant length and the largest characteristic resonant length.

Each slot short-circuited in its middle acts like a parasitic element for the neighboring non-short-circuited slot. Here it is a question of exciting several resonances in order to have an acceptable range of phase shifts, while preventing a highly resonant response leading to low band performances. The coupling between the various resonances, created through coupling between a slot and a patch, attenuates the resonant response.

Figure 7:
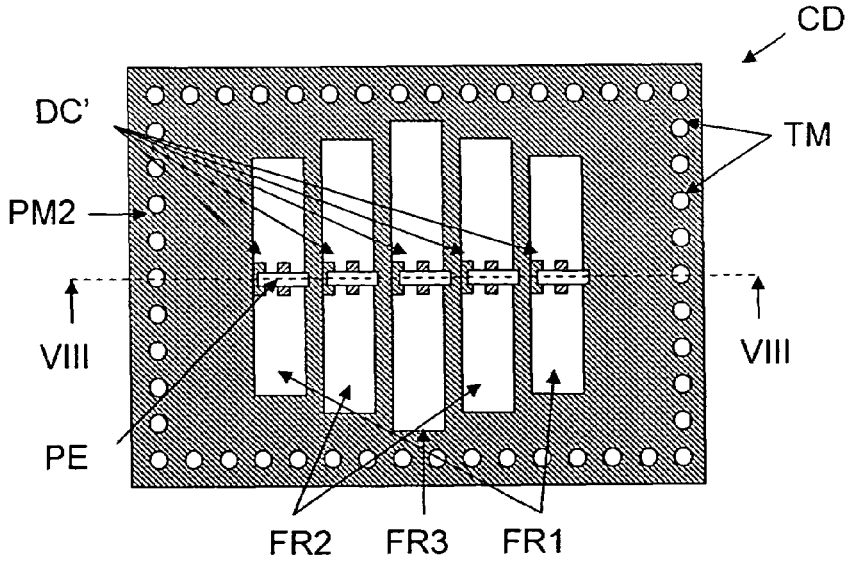

FIGS. 7 and 8 illustrate a fourth example of a phase shifter module CD of the first family. This is a variant of the phase shifter module CD described above with reference to FIGS. 5 and 6.

More specifically, what differentiates the fourth embodiment example from the third is the embodiment of the MEMS devices. In this example, each MEMS device DC with a bridge PT is in fact replaced with an MEMS device DC' with a beam PE, of the type described with reference to FIGS. 3 and 4.

This phase shifter module CD operates in the same way as the phase shifter module described above with reference to FIGS. 5 and 6.

As illustrated in the fifth example in FIG. 9, it is possible to create a phase shifter module CD belonging to the first family that is suited to a double linear polarization.

This requires the use of at least one radiating slot FRV oriented in a first ("vertical") direction, and at least one radiating slot FRH oriented in a second ("horizontal") direction, perpendicular to the first. Of course, as illustrated in FIG. 9, the phase shifter module CD may have one or several radiating slots FRV and one or several radiating slots FRH, according to need. The module is in this case preferably rectangular and has a width roughly equal to half its length.

It is possible to use radiating slots FRV and FRH equipped with only a single MEMS device with a bridge PT or a beam PE, however it is preferable to use radiating slots FRV and FRH that have at least two MEMS devices with a bridge PT or a beam PE (as illustrated).

FIGS. 10 to 18 are now referred to in describing embodiment examples of phase shifter modules belonging to the second family.

FIGS. 10 and 11 illustrate a first example of a phase shifter module CD consisting of a substrate SB with a back (or lower) face, joined to a lower ground plane PM1 defining a lower patch, and a front (or upper) face, joined to an upper ground plane defining an upper patch PS. The upper patch PS and the lower patch PM1 define a resonant planar structure.

The substrate SB is made, for example, from Duroid or TMM and has a low thickness d', typically of around $\lambda/10$ to $\lambda/5$, where $\lambda$ is the vacuum wavelength of the waves to be reflected, originating from the antenna's source.

The upper patch PS is placed roughly parallel to the lower ground plane PM1 and has smaller dimensions. For example, and as illustrated, the upper patch PS is rectangular in shape, and preferably square.

Furthermore, the upper patch PS has a single slot FP, preferably rectangular in shape, defined by two large sides (longitudinal) of length b, and two small sides (transverse) of width a.

This slot FP is created, for example, by etching the ground plane constituting the upper patch PS.

In this embodiment example, the slot FP is equipped with three MEMS devices DC with a bridge PT, each constituting a two-state switch of the type described previously with reference to FIGS. 1 and 2. Of course, the slot FP may have a different number of MEMS devices DC if this number is at least equal to one.

The operating principle of this phase shifter module CD, and more specifically of its MEMS devices DC, is identical to that described previously with reference to FIGS. 1 and 2. Only the physical effect involved differs. The slot FP is here intended to interfere with the path of the currents that circulate in the upper patch PS. By varying the length of the interference slot FP through the establishing of short-circuits chosen by means of at least one of the MEMS devices DC placed in its first state (arrowed), the current path interference is varied, which varies the characteristic resonant length (or electrical length) of the upper patch PS and therefore the phase shifting of the reflected wave.

It is important to note that the invention can only be applied if the upper patch PS is resonant at $\lambda/2$.

FIG. 12 illustrates a second example of a phase shifter module CD of the second family. This is a variant of the phase shifter module CD described above with reference to FIGS. 10 and 11. More specifically, what differentiates the first embodiment example from the second is the embodiment of the MEMS devices.

Here, each MEMS device DC' is of the type with a beam PE, as in the embodiment example described above with reference to FIGS. 3 and 4. Moreover, in this embodiment example, the interference slot IS is equipped with three MEMS devices DC'. However, the interference slot IS may have a different number of MEMS devices DC' if this number is at least equal to one.

As illustrated in FIGS. 13 and 14, at least a third and fourth embodiment example may be envisaged, which are variants of the first and second embodiment examples described above with reference to FIGS. 10 and 12.

More specifically, the third example illustrated in FIG. 13 has two metallic holes (or bushings) TM allowing the electrical coupling of the upper patch PS and the lower ground plane PM1 on both sides of the two opposing ends of the interference slot IS. These metallic holes TM are intended to supply the upper patch PS with a direct current in order to polarize the MEMS device.

In the fourth example illustrated in FIG. 14, the upper patch UP has two interference slots F1 and F2, whose resonance approximately corresponds to a length equal to a quarter of the wavelength, placed roughly opposite each other and coming out onto non-radiating opposite edges. Each small slot F1 and F2 is equipped with at least one (here two) MEMS device with a bridge PT (or a beam PE). Furthermore, a metallic hole (or bushing) TM allows the electrical coupling of the upper patch PS and the lower ground plane PM1 in a central section located between the two small interference slots F1 and F2. This metallic holes TM is intended to supply the upper patch PS with a direct current in order to polarize the MEMS device. Two or more small quarter-wave interference slots may be created, coming out onto at least one of the non-radiating sides.

Of course, it may be envisaged for the upper patch PS (roughly square) to have only one rectangular slot coming out onto a non-radiating side of the square, equipped with at least two MEMS devices DC or DC'.

As illustrated in the fifth example in FIG. 15, it is possible to create a phase shifter module CD belonging to the second family that is suited to a double linear polarization.

To this end, at least two small interference slots F1 and F2 may be used, for example, oriented in a first direction, and at least two small interference slots F3 and F4 oriented in a second direction, perpendicular to the first. Here, "small slot" is understood to mean an interference slot FP of the type presented above with reference to FIG. 14.

It is possible to use small interference slots F1 to F4, of a quarter-wave length, equipped with only a single MEMS device with a bridge PT or a beam PE, however it is preferable to use small interference slots F1 to F4 that have at least two MEMS devices with a bridge PT or a beam PE (as illustrated). The number of MEMS devices used in each slot depends on the number of phase states required.

As in the previous example, a metallic hole (or bushing) TM allows the electrical coupling of the upper patch PS and the lower ground plane PM1 in a central section located between the four small interference slots F1 to F4, of a quarter-wave length. This metallic hole TM is intended to supply the upper patch PS with a direct current in order to polarize the MEMS device.

In the last three embodiment examples (FIGS. 13 to 15), the upper patch PS is powered by at least one metallic hole TM. However, as an alternative, this power may be supplied by a high impedance quarter-wave line.

Figure 16:
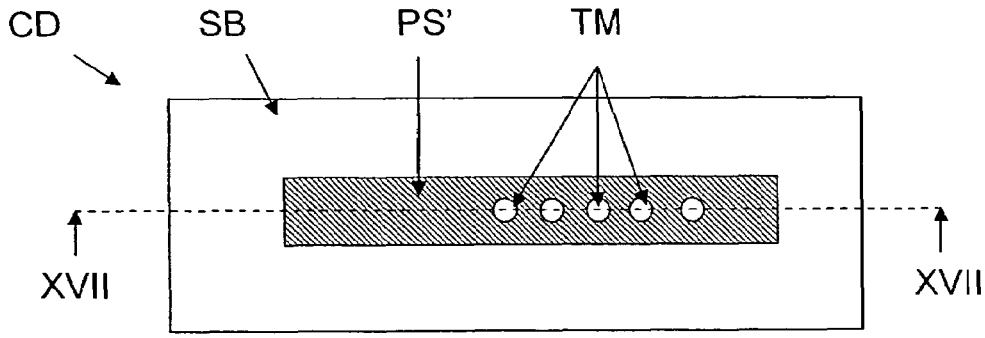
Figure 18:
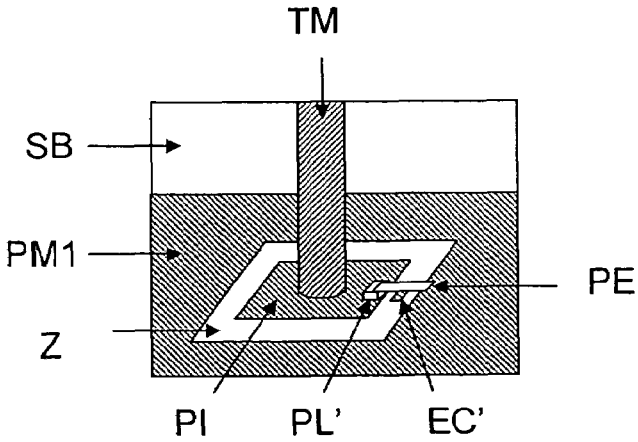
FIG. 18 is a perspective view showing a section of the phase shifter module in FIG. 16, FIG. 19 schematically illustrates, in a top view, a twelfth embodiment example of a phase shifter module according to the invention.

FIGS. 16 and 18 illustrate a sixth example of a phase shifter module CD consisting of a substrate SB with a back (or lower) face, joined to a lower ground plane PM1, and a front (or upper) face, joined to an upper ground plane defining a rectangular upper patch PS'. The upper patch PS' and the lower ground plane PM1 constitute a short-circuited patched structure that defines a resonant planar structure. It is important to note that the length of the upper patch PS is chosen so that it is resonant at $\lambda/4$.

The substrate SB is made, for example, from Duroid or TMM and has a low thickness d', typically of around $\lambda/10$ to $\lambda/5$, where X is the vacuum wavelength of the waves to be reflected, originating from the antenna's source.

The upper patch PS' is placed roughly parallel to the lower ground plane PM1 and has very much smaller dimensions in at least one direction.

As illustrated in FIG. 18, the lower ground plane PM1 has at least one small conducting "wafer" PI, isolated from its own conducting section by a non-conducting zone Z, created, for example, through etching. Each small conducting wafer PI is electrically connected to the upper patch PS' by means of a metallic hole (or bushing) TM. Moreover, each small conducting wafer PI is preferably rectangular, and more preferably square.

Each metallic hole TM is connected to the upper patch PS' in a selected place, the various places being preferably roughly aligned along a line parallel to the longitudinal sides of said upper patch PS.

In addition, each small conducting wafer PI is equipped with an MEMS device with a bridge PT or a beam PE (as illustrated in FIG. 18) of the type previously described. Each MEMS device DC' (or DC) is intended to establish an electrical link between its small lower patch PI and the conducting section of the lower ground plane PM1, when it is placed in its first state (arrowed). Thus, if one of the MEMS devices DC' (or DC) is placed in its first state (arrowed), the metallic hole TM, which is connected to its small conducting wafer PI, short-circuits the upper patch PS' roughly at the place where it is connected, which results in the varying of its characteristic resonant length (or electrical length) and therefore the phase shifting of the reflected wave.

This structure is advantageous as, its devices being placed on the back face, they are more protected from radiation.

Figure 17:
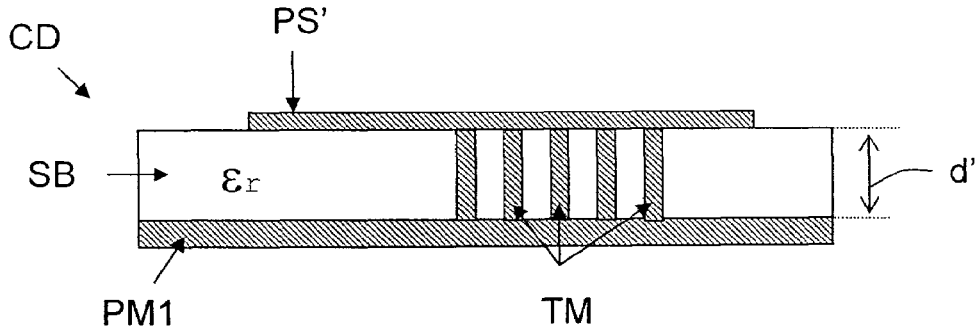
FIG. 17 is a cross-sectional view along the axis XVII-XVII of the phase shifter module in FIG. 16.

In the example illustrated in FIGS. 16 and 17, five metallic holes TM allow the defining of five short-circuits corresponding to at least six different resonant lengths for the upper patch PS'. Consequently, by separately controlling the various MEMS devices DC' (or DC), it is possible to obtain several different phase shifts of the wave reflected by the phase shifter module CD.

Of course, the phase shifter module CD may have a number of MEMS devices (DC or DC') other than five, if this number is at least equal to one. The number of MEMS devices used depends on the number of phase states required.

It is important to note that in this embodiment example, at the resonance frequency, the sum of the "active" dipole length (in other words the length between the short-circuit and the other end of the dipole) and the length of the short-circuit must be equal to a quarter of the wavelength of the guided mode $\lambda_g$.

This embodiment example may allow the creating of a double linear polarization phase shifter module, of the type illustrated in FIG. 9. This requires the combining of "horizontal" dipoles and "vertical" dipoles of the type described above with reference to FIGS. 16 to 18.

Figure 19:
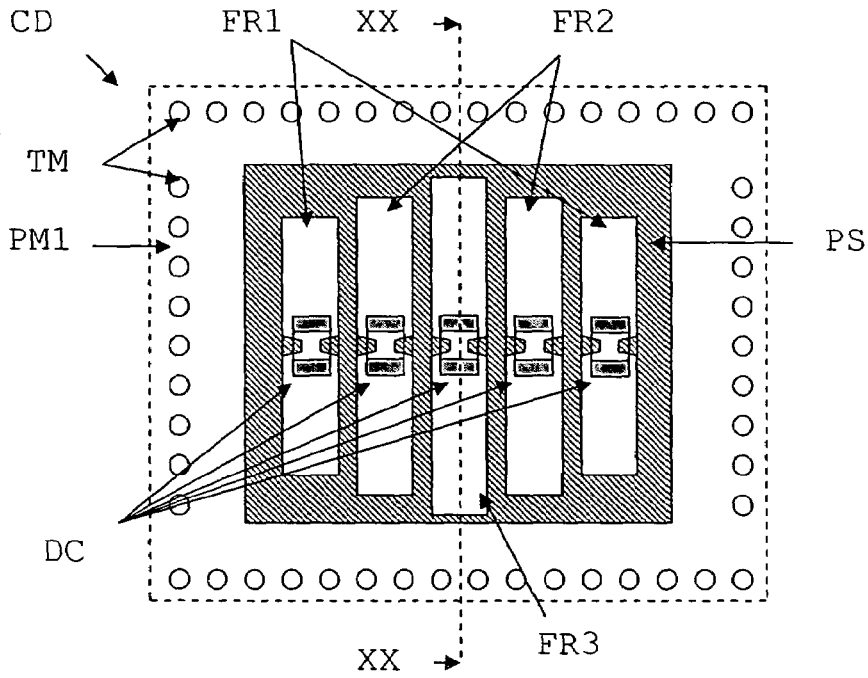
Figure 20:
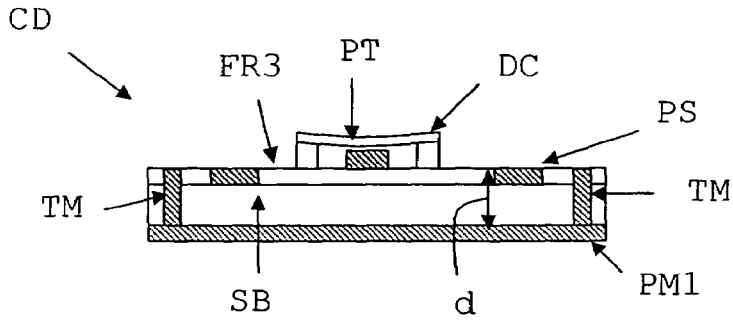
FIG. 20 is a cross-sectional view along the axis XX-XX of the phase shifter module in FIG. 19, FIG. 21 schematically illustrates, in a top view, a thirteenth embodiment example of a phase shifter module according to the invention, without its MEMS devices, FIG. 22 schematically illustrates, in a top view, a fourteenth embodiment example of a phase shifter module according to the invention, without its MEMS devices, FIG. 23 schematically illustrates, in a top view, a fifteenth embodiment example of a phase shifter module according to the invention, FIG. 24 schematically illustrates, in a top view, a sixteenth embodiment example of a phase shifter module according to the invention.

FIGS. 19 and 20 are now referred to in describing an embodiment example of a phase shifter module belonging to the third family.

This embodiment example constitutes a type of intermediate structure between the embodiment examples illustrated in FIGS. 5 to 8 and the embodiment examples illustrated in FIGS. 10 to 12.

Here, the phase shifter module CD consists of a substrate SB with a back (or lower) face, joined to a lower ground plane PM1, and a front (or upper) face, joined to an upper patch PS.

The substrate SB is made, for example, from Duroid or TMM and has a thickness d equal to $\lambda/4$, where $\lambda$ is the vacuum wavelength of the waves to be reflected, originating from the antenna's source.

The substrate SB is crossed, on its periphery, by metallic holes (or bushings) TM connected to the lower ground plane PM1 and surrounding the upper patch PS in order to define a resonant cavity. For example, for operation in the Ku band, the upper patch PS is a square between around 15 mm and around 17 mm long.

Furthermore, the upper patch PS consists of at least two (here five) radiating slots, each with a single MEMS device (DC or DC') with a bridge PT or a beam PE. Of course, the number N of radiating slots illustrated is not limitative. It may take any value greater than or equal to two. For example, the slots have a large side that is between around 5 mm and around 7 mm long, and a small side that is between around 0.3 mm and around 0.7 mm wide.

Some radiating slots may have different lengths. More specifically, in the example illustrated, the upper patch PS has two end radiating slots FR1, with a first characteristic resonant length L1, two intermediate radiating slots FR2, with a second characteristic resonant length L2 greater than L1, and a central radiating slot FR3, with a third characteristic resonant length L3 greater than L2. In one variant, the five slots may have five different lengths.

Here, the five radiating slots FR1 to FR3 are roughly centered in relation to the middle of the upper patch PS, and their MEMS devices DC with a bridge PT (or DC' with a beam PE) are also installed in a centered position (for example).

In this case, only one or several radiating slots are used, their respective MEMS devices DC being placed in their second state (not arrowed). The slots that are not required are short-circuited, by placing their MEMS devices DC in their first state (arrowed). The phase variation of the reflected wave is therefore obtained here by selecting one of the combinations of short-circuited and non-short-circuited slots. Indeed, a specific and discrete phase shift corresponds to each combination, mainly according to the ratio between the smallest characteristic resonant length and the largest characteristic resonant length.

Each slot short-circuited in its middle acts like a parasitic element for the neighboring non-short-circuited slot. Consequently, it is likely to improve the wavelength of the non-short-circuited slot.

In the example described above, the undesirable slots are short-circuited, but this does not have to be the case. For example, the resonant length of certain slots may be modified to excite several resonances and effectively control the phase shifting between slots, with coupling. This modification may take place, for example, by placing one or several (for example two or three) MEMS devices, preferably of the cantilever type DC', in the end sections opposite the slots, rather than in their central sections.

Of course, slots may be used that have roughly the same shapes and dimensions.

Some metallic holes (or bushings) TM, for example one in two, may be advantageously used to route voltage commands to the various MEMS devices DC or DC'.

The above describes modules that have single slots that are a quarter-wave or half-wave long. However, it is possible to create modules with composite slots, as illustrated in FIGS. 21 and 22.

Figure 21:
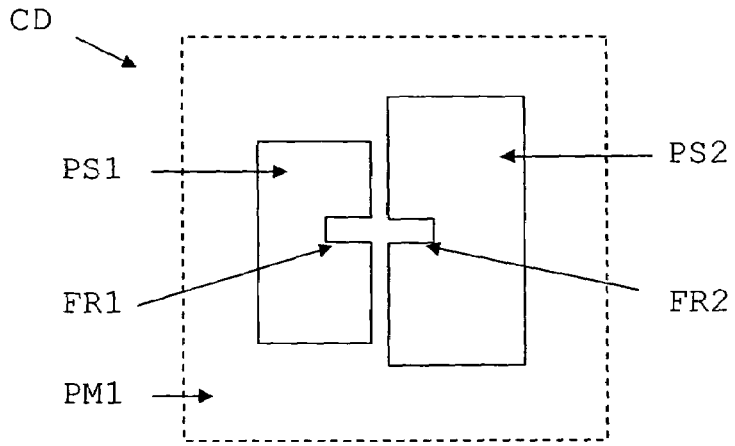
Figure 22:
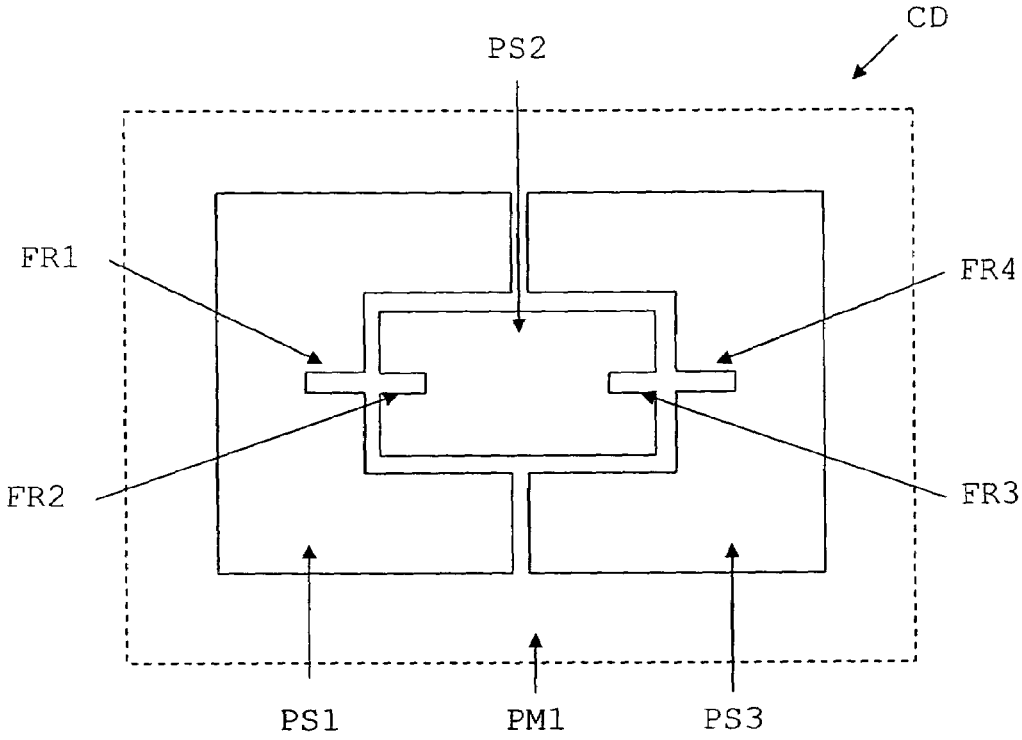

More specifically, the modules in the embodiment examples illustrated in FIGS. 21 and 22 roughly copy the structure of the modules illustrated in FIGS. 10 to 12. Here, each half-wave long slot is comprised of two half-slots a quarter-wave long. The MEMS devices DC or DC' have been deliberately omitted so as not to overcomplicate the drawings.

In the example illustrated in FIG. 21, two upper patches PS1 and PS2 are placed roughly parallel to the lower ground plane PM1 and at a distance from it. These two upper patches PS1 and PS2 are apart from each other by a distance chosen in order to define a capacitive zone between them. They have different shapes and each has a quarter-wave half-slot FR1, FR2. These two half-slots FR1 and FR2 together form a half-wave slot and an inductive zone whose effect is advantageously compensated for (at least partially) by the inter-patch capacitive zone.

For example, the patches have a width equal to around 3.7 mm and are separated by a distance, forming a slot, equal to around 0.1 mm.

Such a dissymmetrical structure offers a stable frequency response owing to an effective coupling between the two resonances.

In the example illustrated in FIG. 22, three upper patches PS1, PS2 and PS3 are placed roughly parallel to the lower ground plane PM1 and at a distance from it. The two upper patches PS1 and PS3 are roughly the same and frame the patch PS2. Moreover, the two upper patches PS1 and PS3 each have a quarter-wave half-slot FR1, FR4, while the upper patch PS3 has two quarter-wave half-slots FR2 and FR3 coming out onto two opposite sides, with one placed opposite the half-slot FR1 of the upper patch PS1 and defining with it a first half-wave slot, and the other placed opposite the half-slot FR4 of the upper patch PS3 and defining with it a second half-wave slot.

Such a symmetrical structure also offers a stable frequency response owing to an effective coupling between the two resonances.

Many other combinations of upper patches may be envisaged. Thus, one option is a combination of several upper patches separated from each other by spaces creating slots of chosen widths with which they form what experts refer to as a "Jerusalem cross". By reducing the width of the opposite slots with an MEMS device, it is possible to act on the resonance frequency of such a structure, and thus modify the phase of the reflected wave. A dual structure, consisting of metal lines in the form of a Jerusalem cross, is in particular described in the document by C. Simovski et al, "High-impedance surfaces with angular and polarization stability", $27^{th}$ ESA Antenna Technology Workshop on Innovative Periodic Antennas, pp 176-184. The resonance of such a structure is mainly provided by the inductive and capacitive sections of the Jerusalem cross, rather than by the resonance of the patches. This "metamaterial" structure thus operates with much lower frequency bands.

It is also possible to join to phase shifter modules that have at least one patch with at least one slot FP, described above, one or several auxiliary patches and at least one MEMS coupling device, in order to vary the dimensions of the patch in at least one of its two directions (X and Y), and preferably along its length X, which is parallel to the direction defining the length b (or large side) of the slots FP. A phase shifter module CD of this type is illustrated in FIG. 23.

More specifically, the phase shifter module CD illustrated in FIG. 23 is based on a structure of the type illustrated in FIGS. 10 and 12. It therefore consists of a substrate SB with a back (or lower) face, joined to a lower ground plane PM1, and a front (or upper) face, joined to at least one upper patch PS and to at least one auxiliary patch PA1, PA2. The present example describes two auxiliary patches PA1 and PA2, placed on either side of two parallel sides of the patch PS (themselves parallel to the large sides (Y) of the slot FP). However, a single auxiliary patch PA may be used. Furthermore, as a variant or complement, an auxiliary patch may also be placed along at least one of the two non-radiating sides of the patch PS (parallel to the small side (X) of the slot FP).

The upper patches PS, PA1 and PA2 and the lower ground plane PM1 define a resonant planar structure.

The phase shifter module CD also has at least one MEMS coupling device DC or DC' installed between the patch PS and an auxiliary patch PA1, PA2, intended to establish or prevent contact between these patches according to the state in which it is placed.

In the example illustrated, the patch PS is able to be connected to each auxiliary patch PA1, PA2 by means of three MEMS devices DC', consisting of one central and two end devices. The two end MEMS devices DC' are preferably placed symmetrically in relation to the centre of the auxiliary patch PA1, PA2.

The various MEMS devices DC' or DC that connect the patch PS to one of the auxiliary patches PA1, PA2 are preferably controlled by the same control current. In other words, they are preferably simultaneously placed in the same state, in order to ensure either an electrical link, or an absence of an electrical link, between the patch PS and the auxiliary patch PA1, PA2 concerned.

If a link is established between the patch PS and an auxiliary patch PA1, PA2, the physical length (along X) of the patch PS may therefore be increased. By simultaneously acting on the length of the patch PS and the length of the slot FP couple, it is therefore possible to simultaneously modify the phase shifting of the incident wave, over a range greater than 360°, and frequency dispersion of this phase shift couple. The possibility of controlling the frequency dispersion of this phase shift is particularly advantageous for compensating for the frequency dispersive illumination of a plane reflectarray by a primary source.

It is important to note that several (at least two) auxiliary patches, preferably of the same dimensions, may be placed parallel to each other on at least one of the two sides of the patch PS, the patches being connected two by two by one or several MEMS coupling devices DC' or DC, and preferably three. This allows still further varying of the patch PS's physical length, according to need, by playing on the respective states of the MEMS devices DC' or DC coupling the auxiliary patches.

Furthermore, the auxiliary patches that are located on either side of the two parallel sides of the patch PS do not need to have the same dimensions. This is notably the case in the example illustrated in FIG. 23, where the auxiliary patch PA1 has a length (along direction X) greater than that of the auxiliary patch PA2, but a width (along direction Y) that is roughly the same as that of the auxiliary patch PA2. For example, if the length of the patch PS is equal to L, the lengths of the auxiliary patches PA1 and PA2 may be equal to L/2 and L/3 respectively.

As in the examples previously described, the patch PS may have one or several MEMS devices DC or DC'. The number of MEMS devices used depends on the number of phase states required.

This type of phase shifter module CD therefore allows the phase shifting and the frequency phase dispersion to be varied according to need, which is particularly advantageous for an active (or reconfigurable) antenna. The choice of phase shifting and phase shifting dispersion is in fact fixed by the physical length of the patch PS and by the electrical length of each slot IS of each patch PS, according to the respective states of the various MEMS devices used.

In order to create a passive phase shifter module CD, for a non reconfigurable antenna, the use of MEMS devices at slot level may be avoided. More specifically, as illustrated in FIGS. 24 and 25, a structure of the type illustrated in FIGS. 10 to 12 may be used, but without MEMS devices.

Such a structure CD therefore consists of a substrate SB with a back (or lower) face, joined to a lower ground plane PM1, and a front (or upper) face, joined to at least one upper patch PS with at least one slot FP. The upper patch PS and the lower ground plane PM1 define a resonant planar structure.

By carefully choosing the dimensions of the upper patch PS, and in particular its length x (along direction X), and of the slot FP, and in particular its length b (along direction Y), and the thickness d of the substrate SB, both a chosen phase shifting and a chosen frequency phase dispersion may be imposed.

Figure 26:
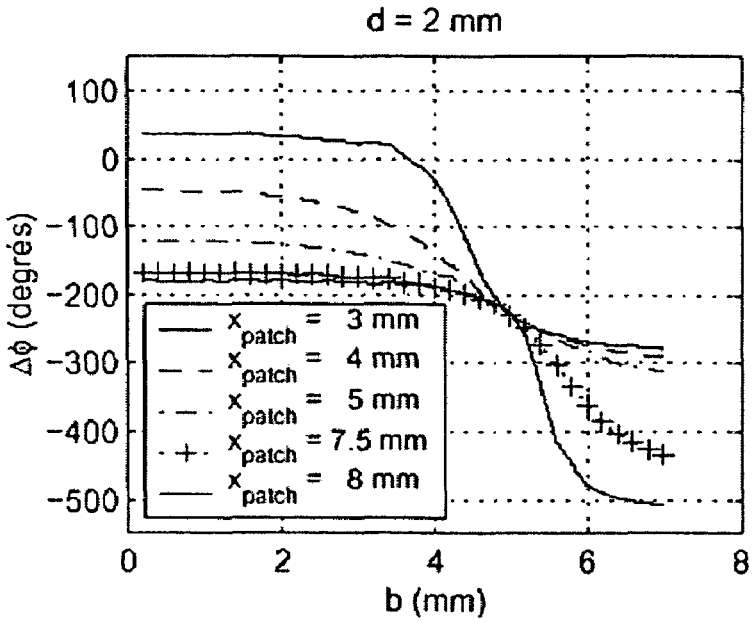
FIG. 26 is a diagram illustrating how the phase shifting ($\Delta\Phi$ in degrees) changes according to the length of a slot (b in mm), for several different upper patch length values (x=3, 4, 5, 7, 5 and 8 mm respectively from top to bottom) and for one substrate thickness (d').

The dimensions and thicknesses may be deduced from curves such as those illustrated in FIG. 26, giving the change in the phase shift $\Delta\Phi$ according to the length b of the slot FP, for several different length values x of the upper patch PS and for a thickness d' of substrate SB (equal to around 2 mm, for example).

If the upper patch PS has only a single slot FP, this is preferably placed roughly in its centre. However, the upper patch PS may have several slots FP, possibly of different dimensions.

Such a phase shifter module CD allows the obtaining of any phase shift, and in particular phase shifts (very much) greater than 360°. It also allows the controlling of the frequency dispersion of this phase shift. Previous phase shifter modules CD, which allow such characteristics to be obtained, have three patches placed parallely above each other and above a lower ground plane (they are in particular described in the article by J. A. Encinar et al, "Design of a three-layer printed reflectarray for dual polarization and dual coverage", 27$^{th}$ ESA Antenna workshop, Santiago de Compostel, Spain, March 2004). The phase shifter modules CD according to the invention have only a single level of plating (upper patch), in addition to the lower ground plane PM1, and are therefore a lot simpler to create than previous phase shifter modules.

The invention is not limited to the phase shifter module and reflectarray antenna embodiments described above, only by way of example, but covers all the variants that may be envisaged by experts within the framework of the claims above.

The invention claimed is:

1. A phase shifter module (CD), for a reflectarray antenna, defined by a characteristic resonant length, characterized by the fact that, in at least one chosen place, it has an MEMS type device (DC, DC'), able to be placed in at least two different states respectively permitting and prohibiting the establishing of a short-circuit intended to vary said resonant length, in order to vary the phase shifting of a wave to be reflected presenting at least one linear polarization, further characterized by the fact that it has a resonant planar structure consisting of an upper patch (PS) placed roughly parallel to a lower ground plane (PM1), at a chosen distance, said upper patch (PS) having at least one slot (FP) equipped with at least one MEMS device (DC, DC') controlling the characteristic resonant length of said upper patch (PS), and further characterized by the fact that it has at least one auxiliary patch (PA1, PA2) placed along at least one of the sides of said upper patch (PS), at a chosen distance from it, and at least one MEMS coupling device (DC, DC'), placed between said auxiliary patch (PA1, PA2) and said upper patch (PS) and permitting or prohibiting the establishing of an electrical link between said auxiliary and upper patches according to the state in which it is placed.

2. A module according to claim 1, further characterized by the fact that said MEMS device (DC) has a flexible conducting bridge (PT) whose states are controlled by two control electrodes placed roughly on top of each other, one of which is comprised of said bridge (PT).

3. A module according to claim 1, further characterized by the fact that said MEMS device (DC') has a suspended flexible conducting beam (PE) whose states are controlled by a control electrode (EC') placed below a suspended section of said beam (PE), which constitutes another electrode.

4. A module according to claim 1, further characterized by the fact that it has a single slot (FP) equipped with at least two MEMS devices (DC, DC'), allowing the defining of at least three resonant lengths (FP) that differ according to the states in which they are respectively placed.

5. A module according to claim 1, further characterized by the fact that it has at least two parallel neighboring auxiliary patches of roughly the same dimensions, placed along at least one of the sides of said upper patch (PS), and at least one MEMS coupling device (DC', DC) placed between said neighboring auxiliary patches, permitting or prohibiting an electrical link between them according to the state in which it is placed.

6. A module according to claim 1, further characterized by the fact that said upper patch (PS) is roughly square, and by the fact that it has at least one rectangular slot coming out onto one non-radiating side of said square and at least two MEMS devices (DC, DC'), allowing the defining of at least three resonant lengths that differ according to the states in which they are respectively placed.

7. A module according to claim 1, further characterized by the fact that said upper patch (PS) is roughly square, and by the fact that it consists of at least a first (F1) and second (F2) rectangular slot placed roughly opposite each other and coming out onto two opposite, non-radiating, sides of said square, each slot (F1, F2) being equipped with at least two MEMS devices (DC, DC'), allowing the defining of at least three resonant lengths that differ according to the states in which they are respectively placed.

8. A module according to claim 7, further characterized by the fact that it has at least a third (F3) and fourth (F4) rectangular slot placed roughly opposite each other and coming out onto two other opposite sides of said square, each slot (F3, F4) being equipped with at least two MEMS devices (DC, DC'), allowing the defining of at least three resonant lengths that differ according to the states in which they are respectively placed, in order to allow a double linear polarization.

9. A module according to claim 1, in combination with claim 2, further characterized by the fact that each slot (FP, F1-F4) is rectangular, and by the fact that each MEMS device (DC) bridge (PT) is placed roughly parallel to the large sides of said slot.

10. A module according to claim 1, in combination with claim 3, further characterized by the fact that each slot (FP, F1-F4) is rectangular, and by the fact that each MEMS device (DC) beam (PE) is placed roughly parallel to the large sides of said slot.

11. A module according to claim 1, further characterized by the fact that said upper patch (PS) has smaller dimensions than the lower ground plane (PM1), and by the fact that it has metallic bushings (TM) connected to said lower ground plane (PM1) and surrounding said upper patch (PS) in order to define a resonant cavity.

12. A module according to claim 1, further characterized by the fact that it consists of an upper ground plane (PM2) with at least one radiating slot (FR) equipped with an MEMS device (DC, DC') controlling its characteristic resonant length, a lower ground plane (PM1) and metallic bushings (TM) connecting said lower ground plane (PM1) to peripheral sections of said upper ground plane (PM2) in order to define a resonant cavity.

13. A module according to claim 12, further characterized by the fact that said upper ground plane (PM2) has at least two radiating slots (FR1, FR2, FR3) each equipped with a single MEMS device (DC, DC') controlling their characteristic resonant length.

14. A module according to claim 13, further characterized by the fact that each MEMS device (DC, DC') is placed roughly in the middle of a radiating slot (FR1, FR2, FR3).

15. A module according to claim 12, further characterized by the fact that said upper ground plane (PM2) has a radiating slot (FR) equipped with at least two MEMS devices (DC, DC'), allowing the defining of at least three slot resonant lengths that differ according to the states in which they are respectively placed.

16. A module according to claim 12, further characterized by the fact that said upper ground plane (PM2) has at least one rectangular radiating slot (FRV) with large sides parallel to a first direction, and at least one other rectangular radiating slot (FRV) with large sides parallel to a second direction perpendicular to the first, in order to allow a double linear polarization.

17. A phase shifter module (CD), for a reflectarray antenna, defined by a characteristic resonant length, characterized by the fact that, in at least one chosen place, it has an MEMS type device (DC, DC'), able to be placed in at least two different states respectively permitting and prohibiting the establishing of a short-circuit intended to vary said resonant length, in order to vary the phase shifting of a wave to be reflected presenting at least one linear polarization, further characterized by the fact that it has a resonant planar structure consisting of an upper patch (PS) placed roughly parallel to a lower ground plane (PM1), at a chosen distance, said upper patch (PS) having at least one slot (FP) equipped with at least one MEMS device (DC, DC') controlling the characteristic resonant length of said upper patch (PS), and further characterized by the fact that said resonant planar structure consists of at least two upper patches (PS1, PS2) that are separated from each other by a chosen distance, each patch having at least one half-slot (FR1, FR2, FR3, FR4) coming out onto one of its sides and two half-slots opposite each other forming a slot.

18. A phase shifter module (CD), for a reflectarray antenna, defined by a characteristic resonant length, characterized by the fact that, in at least one chosen place, it has an MEMS type device (DC, DC'), able to be placed in at least two different states respectively permitting and prohibiting the establishing of a short-circuit intended to vary said resonant length, in order to vary the phase shifting of a wave to be reflected presenting at least one linear polarization, further characterized by the fact that it has a resonant planar structure consisting of an upper patch (PS) placed roughly parallel to a lower ground plane (PM1), at a chosen distance, said upper patch (PS) having at least one slot (FP) equipped with at least one MEMS device (DC, DC') controlling the characteristic resonant length of said upper patch (PS), and further characterized by the fact that said resonant planar structure consists of several upper patches separated from each other by spaces constituting slots of chosen widths, said patches and said slots forming a "Jerusalem cross".

19. A phase shifter module (CD), for a reflectarray antenna, defined by a characteristic resonant length, characterized by the fact that, in at least one chosen place, it has an MEMS type device (DC, DC'), able to be placed in at least two different states respectively permitting and prohibiting the establishing of a short-circuit intended to vary said resonant length, in order to vary the phase shifting of a wave to be reflected presenting at least one linear polarization, further characterized by the fact that it has a resonant planar structure consisting of an upper patch (PS) placed roughly parallel to a lower ground plane (PM1), at a chosen distance, said upper patch (PS) having at least one slot (FP) equipped with at least one MEMS device (DC, DC') controlling the characteristic resonant length of said upper patch (PS), and further characterized by the fact that, on the one hand, it has a resonant planar structure consisting of a rectangular upper patch (PS) placed roughly parallel to a lower ground plane (PM1), at a chosen distance, said lower ground plane (PM1) defining at least one wafer (PI) completely surrounded by a non-conducting zone (Z), placed below said upper patch (PS) and of smaller dimensions than the latter, and on the other hand, at least one metallic bushing (TM) connecting said upper patch (PS) to said wafer (PI), and by the fact that said MEMS device (DC, DC') is placed in said zone (A) in order to establish, in one of its states, a link between said wafer (PI) and the rest of said ground plane (PM1) to control the resonant length of said upper patch (PS).

20. A module according to claim 19, further characterized by the fact that said lower ground plane (PM1) defines at least two wafers (PI) completely surrounded by a non-conducting zone (A), placed below said upper patch (PS) and of smaller dimensions than the latter, and by the fact that, on the one hand, it has at least two metallic bushings (TM) respectively connecting the upper patch (PS) to one of said wafers (WPI), and on the other, at least two MEMS devices (DC, DC') each placed in one of the zones (ZI) in order to establish links between at least one of said wafers (PI) and the rest of said ground plane (PM1), allowing the defining of at least three upper patch (PS) resonant lengths that differ according to the states in which they are respectively placed.

21. A phase shifter module (CD), for a reflectarray antenna, defined by a characteristic resonant length, characterized by the fact that, in at least one chosen place, it has an MEMS type device (DC, DC') able to be placed in at least two different states respectively permitting and prohibiting the establishing of a short-circuit intended to vary said resonant length, in order to vary the phase shifting of a wave to be reflected presenting at least one linear polarization, further characterized by the fact that it consists of an upper ground plane (PM2) with at least one radiating slot (FR) equipped with an MEMS device (DC, DC') controlling its characteristic resonant length, a lower ground plane (PM1) and metallic bushings (TM) connecting said lower ground plane (PM1) to peripheral sections of said upper ground plane (PM2) in order to define a resonant cavity further characterized by the fact that said upper ground plane (PM2) has at least two radiating slots (FR1, FR2, FR3) each equipped with a single MEMS device (DC, DC') controlling their characteristic resonant length, and further characterized by the fact that said slots (FR1, FR2, FR3) are roughly parallel to each other and have different lengths.

22. A phase shifter module (CD), for a reflectarray antenna, characterized by the fact that, in at least one chosen place, it has an MEMS type device (DC, DC'), able to be placed in at least two different states respectively permitting and prohibiting the establishing of a short-circuit intended to vary said resonant length, in order to vary the phase shifting of a wave to be reflected presenting at least one linear polarization, further characterized by the fact that it has a resonant planar structure consisting of an upper patch (PS) placed roughly parallel to a lower ground plane (PM1) at a chosen distance, that has at least one slot (FP), the dimensions of the patch (PS) and the slot (FP) and said distance being chosen so as to impose a chosen phase shift and a chosen frequency phase dispersion on a wave to be reflected presenting at least one linear polarization, and further characterized by the fact that, on the one hand, it has a resonant planar structure consisting of a rectangular upper patch (PS) placed roughly parallel to a lower ground plane (PM1), at a chosen distance, said lower ground plane (PM1) defining at least one wafer (PI) completely surrounded by a non-conducting zone (Z), placed below said upper patch (PS) and of smaller dimensions than the latter, and on the other hand, at least one metallic bushing (TM) connecting said upper patch (PS) to said wafer (PI), and by the fact that said MEMS device (DC, DC') is placed in said zone (Z) in order to establish, in one of its states, a link between said wafer (PI) and the rest of said ground plane (PM1) to control the resonant length of said upper patch (PS).

23. A reflectarray antenna, characterized by the fact that it consists of at least two phase shifter modules (CD) according to claim 22.

* * * * *